United States Patent [19]

Chin et al.

[11] 4,075,437

[45] Feb. 21, 1978

[54] COMPOSITION, PROCESSING AND DEVICES INCLUDING MAGNETIC ALLOY

[75] Inventors: Gilbert Yukyu Chin; John Travis Plewes, both of Berkeley Heights; Bud Caesar Wonsiewicz, Summit, all of N.J.

[73] Assignee: Bell Telephone Laboratories, Incorporated, Murray Hill, N.J.

[21] Appl. No.: 705,994

[22] Filed: July 16, 1976

[51] Int. Cl.[2] ..... H04R 13/02; C22C 38/18; C21D 1/04

[52] U.S. Cl. ..... 179/114 R; 75/126 H; 148/108; 148/120; 148/31.57; 179/120; 335/302

[58] Field of Search ..... 148/120, 121, 100, 101, 148/108, 31.57, 31.55; 75/126 H, 170; 317/143; 340/174 EB, 174 PM, 174 MS, 11; 179/114 R, 115 R, 120

[56] References Cited

U.S. PATENT DOCUMENTS

| | | | |
|---|---|---|---|
| 1,715,648 | 6/1929 | Elmen | 75/170 |
| 2,506,624 | 5/1950 | Wirsching | 179/120 |
| 3,600,162 | 8/1971 | Kaplan et al. | 75/126 H |
| 3,868,278 | 2/1975 | Foster et al. | 148/120 |
| 3,891,475 | 6/1975 | Tomita et al. | 148/31.55 |
| 3,954,519 | 5/1976 | Inoue | 148/31.57 |

FOREIGN PATENT DOCUMENTS

| | | | |
|---|---|---|---|
| 752,317 | 7/1956 | United Kingdom | 148/120 |

*Primary Examiner*—Walter R. Satterfield
*Attorney, Agent, or Firm*—George S. Indig; Edward M. Fink

[57] ABSTRACT

Alloy compositions based on ternary alloys of the chromium-cobalt-iron system modified by addition of zirconium molybdenum, niobium, vanadium, titanium, and/or aluminum, are found to manifest improved formability. Exemplary compositions are magnetic and evidence coercivities of 350–550 Oe., remanent magnetizations of from 10,000 – 7,500 Gauss, and maximum energy products in excess of one million. Improvement in formability may take the form of room temperature stamping, sometimes in air, to final configurations including curvatures of radius equal to thickness. Novel compositions particularly desirable from such standpoint necessarily contain zirconium together with aluminum, niobium, and/or titanium.

22 Claims, 2 Drawing Figures

COMPOSITION, PROCESSING AND DEVICES INCLUDING MAGNETIC ALLOY

BACKGROUND OF THE INVENTION

1. Field of the Invention

The invention is concerned with hard magnetic materials, processes for shaping such materials, and devices utilizing materials so shaped. Shaping is accomplished by steps including working with at least some critical part of the working being conducted at low temperature, sometimes at room temperature. Magnetic properties are sufficient to permit use in many magnetically biased devices, such as, electroacoustic transducers, including receivers, loudspeakers, and the like.

2. Description of the Prior Art

The development history of hard magnetic materials is characterized as a continuing search for higher and higher values of coercivity, remanent magnetization, and energy product. This is evident from consideration of such devices as permanent magnet loudspeakers, where increased energy product results in improved bass response for given magnet size. In receivers too, engineering design considerations, such as air gap and volume, suggest increasing values of coercivity, as well as of energy product. The quest has been accelerated by recent design trends, all of which lead toward increasing miniaturization which, in turn, indicate larger energy product, as well as coercivity to accomplish a desired permanent bias for now reduced proportions.

From many standpoints, it is reasonable to characterize modern, permanent magnet materials as having coercivities of the order of at least 250 Oe. and remanent magnetizations of at least 7,000 Gauss, indicating a maximum energy product of at least 1 million Gauss-oersteds. For real operating devices, the energy product value of concern is that measured along an operating line (or load line) which depends upon design parameters, such as, circuit reluctance, etc.; and here a useful energy product may be somewhat less than the maximum value.

From the standpoint of processing, hard magnetic materials may be classified as belonging to either of two categories. *Brittle* alloys, are exemplified by the Alnico series (see R. M. Bozorth; *Ferromagnetism,* D. Van Nostrand, 1951). Such compositions, based on aluminum, nickel, and cobalt do not lend themselves to working, e.g., by rolling, or drawing. Thus piece parts of such alloys are most expeditiously or necessarily formed by casting or powder metallurgy. *Ductile* alloys, exemplified by the alloys: Cunife (cobalt, nickel, copper and iron), Cunico (cobalt, nickel, and copper) and Vicalloy (vandium, cobalt and iron), can be worked readily at room temperature. Piece parts of such alloys are generally processed by operations such as flat rolling and wire drawing.

From a commercial standpoint, other fabrication approaches are sometimes indicated. An example involves Remalloy, an alloy of iron, cobalt, and molybdenum—e.g., 20 weight percent molybdenum, 12 weight percent cobalt, and the remainder (to equal 100 weight percent) iron. Piece parts of Remalloy, which is in the *brittle* category, are produced by working which, however, requires temperatures exceeding 1,100° C. This exemplary Remalloy composition, already reflecting a compromise between workability and maximization of magnetic characteristics, is notably used in telephone receivers. This alloy is typically formed into a rolled hot band of the order of 100 mils in thickness by a series of steps that include (1) casting of ingot; (2) hot rolling at 1200° C to the desired thickness in a series of rolling operations; (3) stamping to desired configuration with the stamping operation necessarily carried out at elevated temperature; (4) solution heat treatment at 1200° C; (5) grinding to final dimensions; and (6) finally, a terminal heat treatment near 700° C to develop the permanent magnetic characteristic. Such a Remalloy piece part, designed, for example, in the telephone receiver, may have a coercivity of 300 Oe., a remanence of 9,000 Gauss, and a usable energy product of perhaps 1 million Gauss-oersteds.

Hot workable Remalloys, processable as described, are characterized by magnetic properties among the best obtainable for hot workable materials, at least for materials within an acceptable price range for mass production. For certain uses where piece parts are subject to shock, even hot workable Remalloys are unacceptable; and so, for example, even the handset receiver used as an example above, may not be constructed of Remalloy for certain uses, for example, for use in pay telephones where abuse may be expected.

SUMMARY OF THE INVENTION

The invention is primarily concerned with alloys manifesting improved formability. For these purposes, it is convenient to define formability as including a deformation to produce at least a 90° bend to a radius of curvature approximately equal to the thickness of the body being bent. Improvement generally takes the form of permitted lower temperature processing, although exemplary materials have the additional attribution of being resistant to attack by nitrogen, thereby permitting much, if not all, processing to take place in air.

Alloys of particular consequence in accordance with the invention are magnetic and processing may result in remanent magnetization of 7,000 Gauss and higher, coercivity of 300 Oe. and higher, and maximum and typically usuable energy products of 2 million and 1 million gauss-oersteds, respectively.

While the invention is largely defined in terms of the finding that a category of alloys may be processed, as above noted, aspects include (a) designation of novel series of compositions particularly suited to such processing, and (b) products resulting from such processing. All compositions of consequence from the standpoint of the invention are based on the ternary series which may be expressed in parts by weight as 25–30 chromium, 10–20 cobalt, remainder to make up 100 parts iron. All concerned compositions are modified by addition of at least 0.1 percent by weight of at least one of the elements zirconium, molybdenum, niobium, vanadium, titanium, and aluminum. (This percentage based on 100 parts by weight of the ternary composition.) While additional functions may be served, such modifying elements are believed to perform at least one function in common—i.e., suppression of the low temperature sigma phase. Alloys of the invention as modified are consequently largely ferritic (alpha phase). Minimization of the amount of sigma phase reduces brittleness.

Preferred compositions provide for supporession of the gamma phase, as well as the sigma phase. While presence of this phase may have some embrittling effect, its significance is largely concerned with dilution of magnetic moment. Introduction of zirconium has the effect of suppressing both unwanted phases sigma and gamma. Desired processability consistent with the economy are realized by introduction of zirconium together with at least one of the elements aluminum, niobium, and titanium. Novel composition in accordance with the inventive teaching are so defined.

Such added elements perform a most important first function. They render alloys of the class described ductile so that piece parts such as cupped rings can be successfully stamped at room temperature. Preferred compositions of the invention are so processable without need for protective environment so, for example, an exemplayr composition containing both aluminum and zirconium is processable as described at temperatures which need not exceed 900° C with all processing steps being carried out in air.

Materials of the invention are characteristically processed by (1) formation of a massive ingot; (2) sequential hot rollings at temperature of 1200° C and below to a thickness of perhaps 200 mils; (3) water quenching; (4) cold rolling to fifty percent thickness reduction; (5) solution heat treatment, perhaps at 900° C for periods of fifteen minutes to ninety minutes, to produce a fine-grained, recrystalized single phase body (if the solution temperature is excessive, e.g. greater than 1100° C, the structure is recrystallized single-phase but coarse-grained; if the solution temperature is too low, e.g. less than 850° C, the part may fail to recrystallize and also contains a precipitate phase, the so-called sigma phase. Either ocndition renders the part sufficiently brittle that stamping — e.g. into cupped rings — cannot be done successfully at room temperature); (6) rapid quenching (e.g., in iced brine); (7) room temperature forming, as by stamping (it is an important aspect of the invention that this most critical step may be carried out at room temperature); (8) as an optional step, where desired, in contrast to the grinding required for final shaping of usual comparable prior art magnetic materials, material of the invention may be machined to final configuration; (9) heat treatment (aging of the final piece part to produce desired magnetic properties. Heat treatment parameters are dependent upon precise composition and are described in the Detailed Description. Typically, temperatures of 550°-625° C are utilized followed by cooling rates in the range of 10°-25° C per hour for total times of the order of six hours. As in terminal heat treatment of some prior art materials, the effect is a precipitation hardening which in the present case may be characterized as a spinodal transformation. Products of the invention are characterized by inclusion of one or more parts fabricated of compositions herein processed as described. An example is the cupped ring of the telephone receiver of the typical handset.

As a variation in processing, steps 2 to 5 may be combined and modified so that the ingot is hot rolled starting at temperatures of 1200° C sequentially to the final thickness (perhaps 100 mils), ending up with the final rolling temperature at the solution heat treatment temperature (perhaps 900° C for series A (quinary compositions) and 1050° C for series B (quaternary compositions)). In this way, the cold rolling step is eliminated.

The invention is generally described in terms of materials (or processing or products) which are characterized by retention of the described magnetic properties through a series of working steps, the final one of which may be performed at low temperature—even at room temperature—and the final one of which may be carried out on a material which can be stamped at room temperature. However, even though materials of the invention are characterized by such unusual properties, economic or other considerations may dictate use in processes or inclusion in products which do not take full advantage of all such properties, for example, simple tapes or other forms which do not require stamping but which may benefit by improved magnetic properties or economic advantages as compared with competitive prior art materials.

DETAILED DESCRIPTION

1. The Drawing

Figure 1:
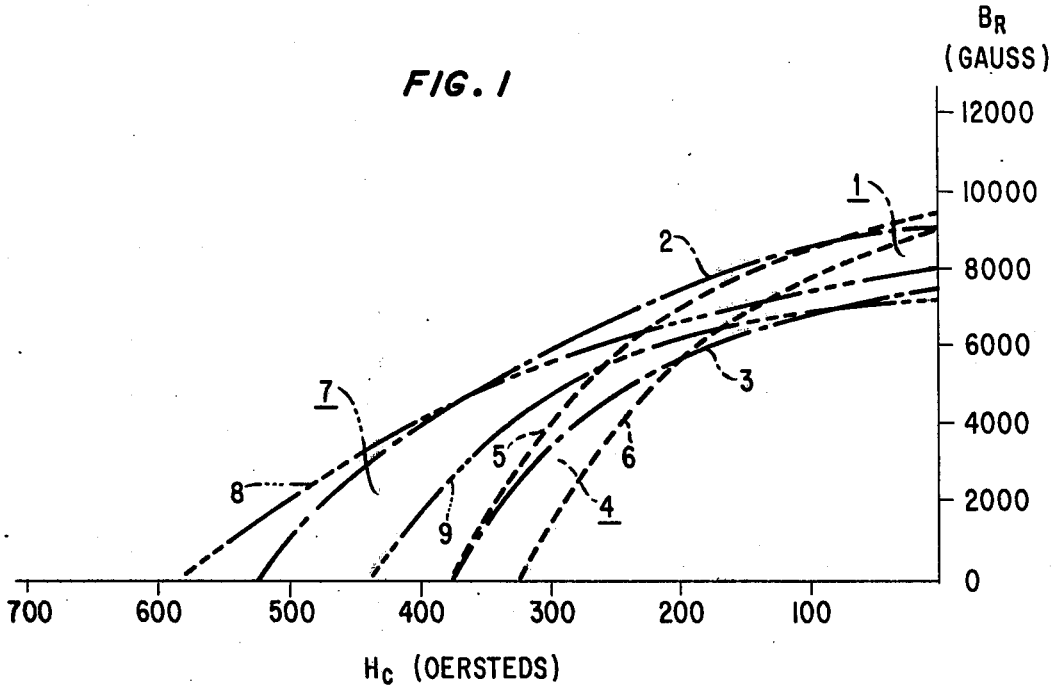
FIG. 1, on coordinates of remanent magnetization, $B_R$ in gauss, on the ordinate, and coercivity $H_C$, in oersteds, on the abscissa, is a plot of the second quadrant of hysteresis loops of a variety of materials, some of prior art, as well as a variety of compositions in accordance with the invention.

The plot of FIG. 1 familiar to design engineers working with magnetic materials includes three bands each defined between maximum and minimum hysteresis loop bounds with such variation in properties within bands resulting from a variety of diverse parameter variations—e.g., composition, heat treatment, degree of working, etc. Band 1, defined as lying between maximum loop bound 2 and minimum loop bound 3, includes a reasonably illustrative range of values which result in compositions of the invention as processed (with a permitted final room temperature forming step). Band 4, bounded between loops 5 and 6, includes reasonably characteristic magnetic properties for hot-worked (as distinguishable from cast) Remalloy compositions. Band 7, included primarily for reference purposes, bounded by loops 8 and 9, is representative of that range of Alnico alloys of coercivity, remanent magnetization, and energy product values comparable with compositions of the invention. The Alnico series is characterized by increasing coercivity and generally also energy product with successive members of the series so that Alnico 5, 4, etc., show lessening values of such parameters.

Figure 2:
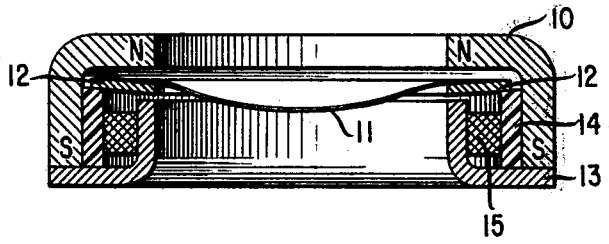
FIG. 2 is a cross-sectional view of a telephone receiver containing an element of cupped ring configuration of a composition herein.

FIG. 2, a cross-sectional view of a typical receiver as found in a telephone handset, consists of cupped ring member 10 of a composition herein which provides a permanent DC biasing magnetic field. Remaining elements include an aluminum diaphragm 11, a vanadium permendur (2% vanadium, 49% cobalt, 49% iron) armature 12, a permalloy (45% nickel, 55% iron) pole piece 13, a non-magnetic nickel-chromium alloy diaphragm seat 14, and a copper wound coil 15. When an AC signal energizes the coil, the resultant magnetic field is superimposed onto the DC field created by the biasing magnet at the gap between armature 12 and pole piece 13. This causes the armature and diaphragm to vibrate. For a detailed description see E. E. Mott and R. C. Miner: "The Ring Armature Telephone Receiver," *Bell System Technical Journal*, Vol. 30, 1951, p. 110.

2. Definitions

Magnetism is a very old art. Terminology, while familiar to the worker in the field, may not have a concise meaning —may vary somewhat depending on the time of usage and the particular specialty involved. For convenience, terminology used in this description is briefly defined.

*Energy product,* BH, is the product of the magnetization B in Gauss and demagnetizing field H in Oersteds along the demagnetization curve, i.e., the second quadrant of the hysteresis loop.

*Maximum energy product,* $(BH)_{max}$, is the highest value of the product of B and H.

*Effective energy product,* $(BH)_{eff}$, is the product of B and H as measured under the operating conditions of a particular device of concern. This product is often shown as the second quadrant intercept of the hysteresis loop and a "load line"—i.e., that line initiating at the origin and extending outwardly whose slope depends on the length and cross-sectional areas of the air gap and of the permanent magnet, hence the magnetic parameters characterized in the environment in which the material is utilized. For devices such as the U-type telephone receiver, such load lines initiate at the origin of the hysteresis loop and extend to include a point in the vicinity of B = 4000 G and H = −250 Oe. For this case, then, $(BH)_{eff} = 4000 \times 250 = 1$ million G-OE.

*Working* is a procedure whereby preliminary shaping is brought about through mechanical deformation. Typical metallurgical procedures falling within this category are swaging, drawing, flat rolling, roll flattening, extruding. Where reference is made to the degree of working, the degree of reduction of the most altered dimension is intended—e.g., 25 percent deformation by flat rolling implies a reduction in thickness of 25 percent.

*Recrystallization* implies a crystalline regrowth generally occurring during a high temperature heat treatment of cold worked material, resulting in a change in crystal morphology from the condition produced during preceding deformation. Complete recrystallization is desirable for maximum ultimate forming but is not necessary to every inventive process herein—only that degree of recrystallization needed to permit the desired deformation is required. In fact, recrystallization carried out at excessive temperatures or prolonged times results in large grain growth and consequent deterioration of subsequent formability. A fine-grained recrystallized structure is generally most desirable for forming.

*Forming* is the final working which results in the final part configuration. It may consist of one or more steps as, for example, a deep drawing step, followed by a stamping step. It is to be distinguished from the initial deformation from the ingot which, in many instances, takes the form of a flat rolling or wire-drawing procedure. The deformation incurred in forming is generally more severe and complex as compared with rolling or wire drawing; material which is rolled successfully could fail in forming. Forming, or stamping, in accordance with the invention, is a low temperature operation permissibly conducted at room temperature. In specific instances it involves the forming of cupped rings for telephone receiver use from 100 mil thick blanks. An acceptable test for such formability would be a satisfactory bend to a 90° angle around a tool with radius equal to the thickness of the strip. Note that while a significant aspect of the invention involves the ability to carry out forming at room temperature, high temperature forming is not precluded.

3. The Composition

Two classes of compositions are contemplated: Series (A) those considered novel—and generally preferred taking account of both formability and economy and Series (B) compositions which, while not necessarily novel, per se, and not necessarily optimum, are found amenable to contemplated forming to result in desired mechanical configuration, as well as magnetic properties.

Both Series (A) and Series (B) compositions are based on mixtures of the three elements 26–28 parts by weight chromium, 15–20 parts by weight cobalt, remainder iron to result in 100 parts by weight of these three elements. Series (B) compositions contain at least 0.1 weight percent based on the recited 100 parts of at least one additional element of the group zirconium, niobium, vanadium, titanium, and aluminum. Series (A) compositions necessarily contain zirconium in the same minimal amount together with at least one of the elements aluminum, niobium, and titanium. Experimental indications dictate the minimum of 0.1 percent as the smallest practical addition resulting in significant measurable improvement. In general, a maximum of about 1.0 percent of each included additional element is indicated (again, regardless of series) so that Series (A) compositions could on this basis contain as much as 4 percent of such additional elements. Maxima indicated are not firm and may vary depending upon processing. It has been found that somewhat greater amounts of aluminum—up to 1.5 percent on the same basis—may generally be tolerated but that titanium may, under extreme processing conditions, result in observable change in grain morphology so that a preferred maximum of 0.5 percent is indicated for this element.

Extreme processing here defined as cold formability to result in a bend of a radius of curvature approximating that of the thickness of the stock material, as well as retention of magnetic properties, is best assured by a preferred compositional range containing at least 0.5 percent by weight of zirconium. Receiver cups of particular consequence from the inventive standpoint are formed from 100 mil stock material.

Compositions of the invention in common with many other magnetic compositions may be affected by environmental constituents. A prevalent effect is nirogen embrittlement which, in severe cases, may significantly impair formability, particularly at lower temperatures and may also impair magnetic properties even where insufficiently severe to significantly impair formability. Nitrogen susceptibility is substantially avoided by use of preferred compositions herein. So that, for example, the use of certain additives or additive additions permit the entire processing sequence to be carried out in air. Zirconium, titanium and aluminum are particularly effective agents for removing nitrogen. In operations which are carried out in the presence of nitrogen, amounts of additives greater than those prescribed by the present invention may be necessary, since formation of nitrides effectively removes combined material. Minimum additions of 0.2% rather than 0.1% at least for one of the elements Zr, Ti or Al satisfies this need.

The additive materials indicated are those required for workability in accordance with the inventive teaching. Certain other additives may be included intentionally for purposes that are well known; for example, manganese may be included in amount of up to one part by weight to bind sulphur which otherwise results in embrittlement. Silicon, again in minor amount, may be added as a flux.

It is no requirement that compositions herein be chemically pure. Unintentional impurities may be tolerated depending on intended use in amount which does not impair or significantly impair grain structure or magnetic properties. An additional limitation on impurities has to do with the impairment of processing under conditions indicated. Generally, commercial grade ingredients are acceptable.

4. Processing

Typical processing steps together with parameter ranges are set forth. Certain optional steps sometimes indicated, sometimes otherwise known to those skilled in the art, are permitted. Certain other variations may be tolerated where maximized processability and magnetic properties are not required.

A suitable processing outline is first set forth:

1. An inggot is formed by conventional processing. For commercial fabrication, ingots are typically 100 pounds or more. Typically, the ingot is formed by melting in an induction furnace. Adequate mixing results from the induced currents inherent to the melting process. Substitution of other heating means may require mechanical stirring. Vacuum or neutral atmosphere is preferred. If processing is carried out in air, adjustment in composition as discussed under "3. The Composition" may be needed.

2. Hot working, as indicated, may be carried out initially at temperatures above about 1200° C but ending at temperatures below about 1100° C. A general purpose served during this hot working is homogenization and recrystallization of the cast structure so as to eliminate the coarse "coring"—i.e., dendritic structure characteristically resulting during casting. For alloys of the present invention and the intended final room temperature formability, however, it is vital that the hot working step be carried out within specified temperature limits. If the hot working temperature is too low, recrystallization may not occur or may be incomplete. In addition, a second low temperature phase, known in the literature as sigma phase, may appear. If the hot working temperature is too high, excessive growth of the recrystallized grain may occur and the likelihood of atmosphere contamination is increased. All these conditions contribute to brittleness in subsequent cold working operations. For best results temperature at the end of the hot working operation should not be above 1200° C nor below 900° C for a zirconium-aluminum alloy nor below 1050° C for a niobium-titanium-zirconium alloy. All limits expressed, as well as understood, assume typical processing. Generally, times of the order of up to about ½ hour and reductions of some dimension of at least fifty percent are contemplated. Decreasing either time or dimensional reduction permits some decrease in minimum permitted temperature for a given state of recrystallization. It is convenient, for many purposes, to carry out this step by hot rolling, since the resulting product is in appropriate configuration for subsequent processing to the shapes contemplated for many of the purposes set forth. Other hot working procedures, such as swaging, extruding, heading, drawing, are suitably substituted from the standpoint of recrystallization. There is, of course, no requirement that any such working take place in but a single pass but, in fact, it is to be expected that this procedural step will involve a number of sequential passes.

3. Quenching: The hot worked body must be reduced from its final elevated temperature to at least 400° C at a cooling rate of at least 100° C per second. This is easily accomplished by simple water quenching using conventional facilities.

4. Cold working: The purpose of cold working is to produce a fine grained structure upon subsequent solution heat treatment (Step 5) which, in turn, permits the low temperature forming of Step 7. Regardless of the working procedure utilized, i.e., swaging, drawing, rolling, etc., a range of from 30–70 percent is generally desirable for formability as contemplated. Outside this range, an intermediate product may still be sufficiently deformable to meet a particular device need. So, for example, for the extreme case in which Step 7 does not involve stamping at all but might result, for example, in a simple tape, this cold working may be carried out over the broader range of from 30 percent to 90 percent or greater. The lower limit of about 30 percent is indicated by virtue of the fact that lesser dimension reduction does not result in sufficiently uniform deformation of the product so that the grain structure becomes inhomogeneous after the solution heat treatment.

5. Solution heat treatment: This is a simple heating into the temperature regime whereby a single phase structure, known in the literature as alpha, exists. This treatment, for preferred compositions herein, may be carried out in a normal air atmosphere, and generally requires sufficient time to raise the innermost portion of the worked body to minimum temperature and to maintain it for an additional period of perhaps 10–15 minutes. Typically, depending upon ingot size, the entire solution heat treatment processing may require heating for a period of from 30 minutes to 90 minutes. The maximum is dictated by diffusion of and reaction with nitrogen. Nitrogen attack, minimized for preferred compositions of the invention, is found to cause some embrittlement with attendant processing difficulty at that level. Worked bodies at this stage are perhaps 100 mils in thickness and may be in the form of a loosely wound coil or other configuration which minimizes thermal lag. It follows that the cross-section of the as-worked body subjected to this step may have a thickness as great as one inch without need for exceeding the critical 90 minute limit (a cross-sectional thickness far in excess of that ordinarily produced by the preceding cold working step and, in fact, greater than thicknesses expedient for the following quenching step).

6. Quenching: This process is designed to retain the high temperature "alpha" phase. The kinetics of the transformation suggest a cooling rate which is appreciably greater than that of Step 3. While no requirement, it has been found expedient to quench in iced brine at least to a temperature of 400° C. For typical dimensions at this stage, this amounts to a cooling rate in excess of 1,000° C/second. Slower rates, particularly for fine dimensioned bodies, are adequate for complete retention of the high temperature phase. Under certain circumstances where forming does not require large distortion, existence of a multiphase body after quenching is permitted; and, in fact, under certain circumstances, the quenching may be eliminated altogether. Even in such instances, however, a solution treatment and a quench will eventually be required to develop the magnetic properties characteristic of the inventive compositions.

7. Forming: It has been stated that a significant characteristic of the alloys at this stage is permitted forming at room temperature. Formability is desirable for all but the simplest configurations and is necessary, for example, for the cupped ring for the receiver shown in FIG. 2. Such forming at room temperature constitutes a preferred embodiment of the invention. It may be accomplished in any of several procedures, for example, the ring configuration of FIG. 2 is produced by progressive die stamping or by compound die stamping. In accordance with the progressive stamping procedure, a flat configuration is changed to a cupped configuration in perhaps four steps—all carried out cold and without need for intermediate treatment. This is a commercially significant aspect of the invention.

Simpler configurations which may or may not require the same degree of formability can utilize any of a variety of classical techniques—e.g., heading.

If the inventive teaching could be briefly stated, it would revolve about the finding of cold workability. It has been indicated that magnetic elements may be formed by stamping to result in cup shapes evidencing curvature about a radius approximately equal to the thickness to produce a 90° bend. Since the permitted radius of curvature becomes larger for greater change in direction, it is convenient to describe cold formability in terms involving these two parameters. For these purposes, it is appropriate to describe cold formability as permitting a change in direction of 25° at a radius of curvature equal to the thickness of the material being formed with radius increasing linearly with increasing change in direction to include the value of radius of curvature equal to four times the thickness for a change in direction of 90°.

8. Magnetic aging: Final thermal treatment required to develop the appropriate magnetic characteristics consists of holding the specimens at temperature typically between 600°-640° C for a period from about 10 minutes up to about 2 hours. It is usual to ramp to a lower temperature to perhaps within the range of from 500° to 525° C and to hold from 1-4 hours.

Operation within the exemplary conditions set forth results in useful magnetic properties in any of the alloys discussed. Processing specification to result in properties tailored to a particular end use is expedited by a consideration of the responsible mechanism. The mechanism is one which may be broadly described as precipitation hardening (although the specific precipitation mechanism may take the form of a spinodal decomposition). It is well known that coercivity, dependent upon domain wall reversal, is, in turn, related to size and spacing of precipitant. The usual technique, once relevant conditions have been identified, involves high temperature treatment during which precipitation (or decomposition) is initiated, generally followed by cooling under conditions such that precipitation (or decomposition) is controlled to produce desired "hardness." Phase boundaries and kinetics play their traditional role and best conditions are empirically determined. Appropriate magnetic properties for a variety of end uses have been experimentally produced with various heat treatment schedules usually involving high temperature treatment at the said range of 600° - 640° C but sometimes cooling directly to room temperature—sometimes holding at an intermediate temperature—at a variety of cooling rates.

In general, useful results obtain by holding at an elevated temperature for a period of at least 10 minutes. Where slow cooling is carried out, rates no faster than about 50° C/hour are generally indicated, since much faster rates essentially fix the conditions produced during the high temperature treatment. While variations are possible—indeed, are indicated in at least one specific example—cooling is usually carried to a temperature no lower than about 500° C. Further controlled cooling at economically feasible rates have little effect due to severely reduced kinetics at lower temperatures. It has, however, been found useful to maintain a temperature, for example, at 500° C for periods of an hour or more and such a schedule is an example of a permitted alternative approach.

It is unnecessary to subject material under treatment to an external magnetic field during aging. The use of such external magnetic fields, however, is not precluded and may be useful for certain configurations.

Procedures as carried out in the numerical order set forth constitute usual preferred aspects of the invention. It has been indicated that variations are permitted—indeed are sometimes indicated by economics; so, for example, the quenching of Step 6 may be eliminated altogether. For many purposes, steps crucial to processing of alloys of the invention may be restricted to Steps 1, 2, and 6 through 8. Such a process may be adequate where forming requirements (Step 7) are not stringent and, in certain instances, may even suffice for the 90° forming described. For such an optional process involving severe forming, however, it is importat that hot working (Step 2) terminate at a temperature prescribed for the solution heat treatment of now omitted Step 5. The aim here is to develop a fine-grained, recrystallized single-phase structure which is necessary for room temperature formability (Step 7). Hot working (Step 2), under these circumstances should terminate with a temperature of about 900° C for the zirconium-aluminum alloy and about 1050° C for niobium-titanium-zirconium alloy.

The broad processing limits set forth above are usefully applied to any of the included alloys of the invention. Compositional examples, all based on the same ternary composition but with various amount and kind of additional elements, were processed into final receiver cup rings (detail 10 of FIG. 2). The following Table sets forth four such compositions indicating minimum and maximum solution heat treatment termperatures permitting required forming.

TABLE (All compositions 28 Cr, 15 Co, remainder Fe additionally contain 0.5 weight percent Mn and 0.2 weight percent Si.)

| Percentages of Added Elements | Solution Temperature, Degrees C | |
|---|---|---|
| | Minimum | Maximum |
| 1% Nb-1% Al | 950 | 1100 |
| 3% V-0.5% Ti | 1000 | 1100 |
| 1% V-1% Nb | 1000 | 1100 |
| 3% Mo-1% Nb | 1100 | 1150 |

8. Examples

Example numbers 1 through 6 illustrate the use of a variety of compositions in accordance with the invention. In each instance, the specimen is capable of being formed into cupped rings suitable for use in a telephone receiver as depicted in FIG. 2. Examples 4 and 5 actually include this forming step.

Example 1

The alloy produced is of the composition 15 parts cobalt, 26½ parts chromium, 58½ parts iron—all by weight—together with 0.25% zirconium, 1.0% aluminum, and 0.5% manganese—all weight percent based on 100 parts of ternary. Amounts of initial materials all introduced as the elements totaled 200 pounds. The ingot was produced by vacuum induction melting. Analysis revealed a content of approximately 0.25% silicon as an unintentional inclusion. Other impurities totaled an amount less than 1.0 percent. After stripping the mold and permitting the ingot to reach room temperature in air, it was reheated to 1200° C and was hot rolled in about 20 passes to result in a thickness of 200 mils. During rolling, the temperature fell to approximately 1100° C. The rolled body was water quenched in tap water. Cold rolling on a reversing mill with about four passes resulted in a thickness reduction of about 100 mils. Material was then reheated in air to a solution temperature of 900° C for 30 minutes and then iced brine-quenched. The quenched body was aged in air at a temperature of 620° C and was maintained at such temperature for 30 minutes and was then ramped at a rate of 25° C per hour to a final temperature of 525° C, was held at such temperature for 4 hours and was then permitted to air cool to room temperature. Magnetic properties were: $H_C$ = 450 Oe., $B_R$ = 8300 Gauss, $BH_{eff} = 1.6 \times 10^6$ Gauss-Oersteds.

Example 2

The procedure of Example 1 was followed, however, to produce the following composition: 15 parts cobalt, 26½ parts chromium 58½ parts iron, 1 percent niobium, 0.25 percent titanium, 0.25 percent zirconium, and 0.5 percent manganese. Silicon content and other impurities were the same as in Example 1. Solution temperature as 1050° C in lieu of 900° C. Magnetic aging followed the following schedule: 625° C for 20 minutes, ramped at a rate of 16° C per hour to 540° C, held at such temperature for 4 hours and was air cooled to room temperature. Magnetic properties were: $H_C$ = 480 Oe., $B_R$ = 8700 G, $BH_{eff} = 1.7 \times 10^6$ Gauss-Oersteds.

Example 3

Ingot of alloy of Example 1 was reheated to 1200° C and was hot rolled directly to 100 mils thickness at which time the temperature was about 900° C. The rolled body was water quenched in tap water. Samples wer reheated to 620° C and immediately ramped at a rate of 11° C per hour to 505° C, held at such temperature for 6 hours and then permitted to air cool to room temperature. Magnetic properties were: $H_C$ = 510 Oe, $B_R$ = 6800 G, $BH_{eff} = 1.35 \times 10^6$ Gauss-Oersteds.

Example 4

The alloy of Example 1 was processed in the manner of Example 1 to 100 mils, was iced brine-quenched, and was stamped to yield cupped rings prescribed for U-type telephone receivers. The stamped body was aged at 620° C for 10 minutes and was then cooled to 520° C at a rate of 25° C per hour. After aging at this temperature for 1 hour, the temperature was lowered to 510° C and held for four additional hours and then permitted to air cool to room temperature. The cupped ring was fabricated into a telephone receiver and the standard flux test read 6900 maxwells.

Example 5

The alloys of Example 2 were processed in the manner of Example 2 to 100 mils and in the iced brine-quenched condition were stamped to yield cupped rings prescribed for U-type telephone receivers. The stamped body was aged at 625° C for 10 minutes and the temperature was then lowered at a rate of 25° C per hour to 525° C. After aging at this temperature for 1 hour, the cupped ring was alowed to air cool to room temperature. The cupped ring was fabricated into a telephone receiver and the standard flux test read 7300 maxwells.

Example 6

The procedure of Example 1 was followed, however, to produce the following composition: 15 parts Co, 27 parts Cr, 58 parts iron, 1 percent Nb, 3 percent Mo, and 0.5 percent Mn. Silicon content was the same as in Example 1. A solution temperature of 1100° C was found appropriate. Magnetic aging followed the schedule: 615° C for 50 minutes, followed by a ramp at 16° C per hour to 540° C, held at said temperature for 7 hours and air cooled to room temperature. Magnetic properties were $H_C$ = 500 Oersteds $B_R$ = 8400 Gauss, $BH_{eff} = 1.75 \times 10^6$ Gauss-Oersteds.

What is claimed is:

1. Method for producing a magnetic element which comprises mechanically working stock material comprising the ternary composition chromium 25–30 parts by weight, cobalt 10–20 parts by weight, remainder iron to total 100 parts by weight, the said composition additionally comprising at least 0.1 weight percent of at least one element selected from the group consisting of zirconium, molybdenum, vanadium, niobium, titanium, and aluminum which comprises the steps of (a) hot rolling a formed ingot, (b) rapidly quenching the ingot, (c) subjecting the resultant quenched ingot to room temperature forming so as to result in deformation of the stock material, such deformation including bending to produce a change in direction of at least 30° with such bending having a radius of curvature which attains a magnitude at least as small as a value which is inversely proportional to the extent of change in direction with such magnitude corresponding with a 30° change in direction being no greater than equal to the thickness of the said stock material and the radius corresponding with a 90° change in direction being no greater than four times the thickness of the said stock material and, (d) magnetically aging the formed product to develop desired magnetic characteristics.

2. Method of claim 1 in which the said magnitude is approximately equal to twice the thickness of the said stock material.

3. Method of claim 2 in which the said magnitude is approximately equal to the thickness of the said stock material.

4. Method of claim 1 in which working involves cupping the said stock to produce a bend defining a continuous curve.

5. Method of claim 4 in which the said bend has a least radius of curvature which is no greater than the thickness of the said stock.

6. Method of claim 1 in which said aging includes heating to increase magnetic coercivity.

7. Method of claim 6 in which said heating includes maintaining at an elevated temperature of at least 600° C for a period of at least ten minutes.

8. Method of claim 6 in which said magnetic aging includes cooling at a maximum rate of 50° C per hour down to a temperature of no greater than about 500° C.

9. Method of claim 1 including a first working step conducted at an initial temperature above about 1200° C.

10. Method of claim 9 in which said first working step is succeeded by a first quenching at a rate of at least about 100° C per second to a temperature at least as low as about 400° C.

11. Method of claim 10 in which said first quenching is followed by cold working to result in a reduction in a dimension of at least 30 percent.

12. Method in accordance with claim 1 which further comprises the steps of (1) water quenching the rolled ingot, (2) cold rolling the ingot to about 50 percent thickness reduction, and (3) solution heat treating the cold rolled ingot for a time period ranging from 15–90 minutes, thereby resulting in a fine grain, recrystallized single phase body, said steps being performed subsequent to hot rolling and prior to rapid quenching.

13. Method of claim 12 in which said solution heat treatment continues for from about 30 minutes to about 90 minutes.

14. Method of claim 1 in which the said composition includes zirconium in amount of at least 0.1 weight percent based on the said 100 parts by weight.

15. Method of claim 14 in which the said composition contains at least 0.1 weight percent aluminum on the same basis.

16. Method of claim 14 in which said composition contains at least 0.1 percent niobium and at least 0.1 percent titanium on the same basis.

17. Cold formable magnetic alloy in the ternary system chromium, cobalt, iron consisting essentially of from 25–30 parts by weight chromium, 10–20 parts by weight cobalt, 50–65 parts by weight iron and at least 0.1 weight percent zirconium, together with at least 0.1 percent, by weight of one additional element selected from the group consisting of aluminum, niobium and titanium, said alloy being prepared in accordance with the method of claim 1.

18. Alloy of claim 17 in which all additional elements are contained in amount of at least 0.2 weight percent on the same basis.

19. Transducer for converting electrical energy to mechanical energy, said transducer including a conducting coil through which electrical current is passed, a cupped magnetic element and an armature of a soft magnetic material carrying a diaphragm so that said armature is biased by the said cupped magnetic element and responds to changes in current in the said conducting coil so as to produce a mechanical movement in the said diaphragm responsive to a change in the magnitude of current in the said conducting coil, wherein the said cupped magnetic element is a cold formed body formed from stock material of a composition comprising the ternary composition chromium 25–30 parts by weight, cobalt 10–20 parts by weight, iron remainder to total 100 parts by weight, said composition additionally containing at least 0.1 weight percent of at least one element selected from the group consisting of zirconium, molybdenum, vanadium, niobium, titanium, and aluminum, and being prepared in accordance with the method of claim 1.

20. Transducer of claim 19 in which the said cupped magnetic element is stamped to yield a bend along a continuous curve, such bend having a radius of curvature which attains a magnitude at least as small as a value which is inversely proportional to extent of change in direction with such magnitude corresponding with a 30° change in direction being no greater than equal to the thickness of the said stock material and the radius corresponding with a 90° change in direction being no greater than four times the thickness of the said stock material.

21. Transducer of claim 20 in which the said composition contains at least 0.1 percent zirconium together with at least one additional element selected from the group consisting of (a) at least 0.1 percent aluminum and (b) both at least 0.1 percent niobium together with at least 0.1 percent titanium with all percents expressed as weight percent based on additions made to the said 100 parts by weight.

22. Transducer of claim 21 in which the said bend defines a change in direction of at least approximately 90°.

* * * * *

UNITED STATES PATENT AND TRADEMARK OFFICE

CERTIFICATE OF CORRECTION

PATENT NO. : 4,075,437

DATED : February 21, 1978

INVENTOR(S) : Gilbert Y. Chin, et al.

It is certified that error appears in the above-identified patent and that said Letters Patent are hereby corrected as shown below:

Column 1, line 46, ";" should read --:--. Column 2, line 10, "characteristic" should read --characteristics--. Column 2, line 64, "supporession" should read --suppression--. Column 3, line 5, "composition" should read --compositions--. Column 3, line 13, "exemplayr" should read --exemplary--. Column 3, line 19, "temperature" should read --temperatures--. Column 3, line 24, "recrystalized" should read --recrystallized--. Column 3, line 30, "ocndition" should read --condition--. Column 3, line 40, "(aging" should read --(aging)--. Column 6, line 41, "nirogen" should read --nitrogen--. Column 7, line 14, "inggot" should read --ingot--. Column 10, line 38, "termperatures" should read --temperatures--. Column 11, line 26, "as" should read --was--. Column 11, line 39, "wer" should read --were--. Column 11, line 66, "alowed" should read --allowed--.

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*